United States Patent [19]

Sorrell et al.

[11] Patent Number: 4,749,019

[45] Date of Patent: Jun. 7, 1988

[54] METHOD AND APPARATUS FOR IMPROVED PRODUCTION CASTING OF MOLTEN METAL

[75] Inventors: Lowell E. Sorrell, Findlay; William E. Barnes, Assumption, both of Ill.

[73] Assignee: Wagner Castings Company, Decatur, Ill.

[21] Appl. No.: 941,162

[22] Filed: Dec. 12, 1986

[51] Int. Cl.[4] ..... B22C 9/20; B22D 41/00

[52] U.S. Cl. ..... 164/130; 164/133; 164/337; 164/323

[58] Field of Search ..... 164/130, 133, 136, 322, 164/323, 324, 335, 337

[56] References Cited

U.S. PATENT DOCUMENTS 3,996,996 12/1976 Gunnergaard ..... 164/130

4,549,600 10/1985 Kauserud ..... 164/130

*Primary Examiner*—Nicholas P. Godici

*Assistant Examiner*—Richard K. Seidel

*Attorney, Agent, or Firm*—Wallenstein, Wagner, Hattis & Strampel, Ltd.

[57] ABSTRACT

This invention relates to the production casting of molten metal. In such casting, the molten metal being poured into one cavity may be splashed or overflowed into another adjacent cavity. The invention provides a splash guard which defines a barrier to the molten metal and prevents such inadvertent introduction of the molten metal into an adjacent cavity. The splash guard preferably comprises a substantially solid object made of a material, such as graphite, that retains its structural integrity at high temperatures and upon contact with molten metal, but which does not strongly adhere or bond to the molten metal upon cooling. The invention can be embodied in both manual and automatic casting lines. In a manual casting line, the splash guard may physically contact a surface of the mold to create the molten metal barrier between the cavities. In an automated casting line, the splash guard may be raised above the mold surface, and form the molten metal barrier through use of the surface tension of the molten metal, so as to avoid interference with the weighing scales on the automated pouring device.

13 Claims, 3 Drawing Sheets

METHOD AND APPARATUS FOR IMPROVED PRODUCTION CASTING OF MOLTEN METAL

BACKGROUND OF THE INVENTION

This invention relates generally to a technique to improve the manufacture of metal castings, particularly in a production line environment. The invention relates, more particularly, to a technique for preventing molten iron which is being poured into a first cavity from being splashed, overflowed, or otherwise inadvertently introduced into an adjacent second cavity. Most particularly, this invention relates to improvements in production line casting techniques which use continuously produced molds of the "door and ram" type, such as those involved with the well known "Disamatic" machine.

Production line casting of molten metal typically involves large scale, complex operation. A batch of molten metal weighing several thousand pounds at temperatures in excess of 2000° F. must be formed into individual castings in the relatively short time interval during which the temperature of the metal remains within a certain temperature window, i.e., a temperature range with upper and lower limits whose numbers depend upon the metal and component being cast.

The molten iron is typically held in a large ladle. Castings are made by pouring molten metal from the ladle into a cavity. The passage leading from the surface of the mold to the cavity is referred to as the downsprue. The cavity and downsprue are formed by various techniques according to the selected method of mold manufacture.

One technique for mold manufacture, not involved with this invention, creates molds which are sometimes described as "cope and drag" molds. For purposes of this invention, these mold types involve a top mold half and a bottom mold half which join together to define a single, distinct mold having a distinct cavity. Such a mold is physically separate and distinct from other similar molds in the casting operation and, thus, the problem of splashing or overflow of molten metal from one mold to another is relatively small.

Another technique for mold manufacture, which is associated with this invention, creates a mold having two embossed surfaces, i.e., a front surface and a rear surface. The front embossed surface, referred to as the "door half," embodies one-half of the cavity and downsprue. The rear embossed surface, referred to as the "ram half," embodies the second half of the cavity and downsprue. In operation, the door half of a first mold abuts the ram half of a second mold to form a complete cavity and downsprue. Molds formed in this manner do not function as separate and distinct molds, but rather do function and advance in series sequence, because any given mold can only create a cavity and downsprue in cooperation with an adjacent mold. Molds of this type are made by the well known "Disamatic" machine. Other similar examples of such mold making techniques are also commercially available and well known.

When molten metal is poured into a first cavity during a production casting operation of the series sequence type, the molten metal may inadvertently enter another cavity which happens to be adjacent the first cavity. For the purpose of this application, the term "first cavity" will refer to that cavity in the casting operation which is the intended recipient of molten metal being poured at any specific time. Similarly, for the purpose of this application, the term "second cavity" will refer to a cavity which happens to be adjacent to or, more generally, in the physical proximity of the first cavity.

The inadvertent introduction of molten metal into the second cavity can occur in various ways. Molten metal may overflow from the first cavity into the second cavity. Alternatively, molten metal may splatter when it is poured into the first cavity, and droplets of the molten metal may splash into the second cavity.

Regardless of how it occurs, the introduction of molten metal into the second cavity creates serious quality control problems for the casting manufacture. The molten metal cools rapidly in the second cavity, forming nodules of solidified metal referred to as "cold shots". The metallurgic properties of cold shots will usually be unacceptable and outside the range of acceptable metallurgic properties for which the casting was designed, because the cooling rate of the molten metal in the area of the cold shots will have been substantially altered from the intended rate of cooling. Moreover, if molten metal is subsequently poured into the second cavity, i.e., when the second cavity is moved into the pouring position, the newly poured metal may not properly bond with the cold shots. These and other related situations can give rise to a variety of serious deficiencies in the casting.

Casting companies have developed various ad hoc approaches to this problem. However, no known effective solution to this problem has developed heretofore. Moreover, many of the prior attempts by the trade to solve the problem have been treated as trade secrets by casting manufacturers and have not been disclosed to the public. As a result, relatively little information is believed to be publicly available on solutions for this problem.

SUMMARY OF THE INVENTION

One object of this invention provides a method and apparatus to prevent molten metal which is being poured into one cavity mold from being inadvertently introduced into an adjacent cavity.

A further object of the present invention is to provide a method and apparatus for improving the quality control in production of metal castings using sequential adjacent molds of the door-and-ram type.

Yet still another object of the invention provides a method and apparatus for adapting the foregoing advantages to high speed automated molten metal pouring systems.

One more advantage of the present invention provides a method and apparatus for accomplishing the foregoing advantages without interfering with the scales on an automated molten metal pouring device.

A preferred object of the invention is to accomplish the foregoing advantages in connection with the casting of molten iron, but the casting of other molten metals are contemplated.

The present invention provides an improved technique for the production casting of molten metal in systems utilizing multiple adjacent mold forms, cavities and downsprue. In the systems related to this invention, a single mold defines at least portions of first and second downsprue and first and second cavities. Each downsprue leads to at least one cavity. Preferably, in operation, the molds will be physically adjacent one another, with one surface of a first mold being adjacent another surface of a second mold to thereby define a first downsprue and first cavity. Similarly, another surface of the first mold will be adjacent a surface of yet another mold to define a second downsprue and second cavity. The mold will also have a surface, preferably a top surface, that extends in a substantially continuous manner between the portions of the first and second downsprue defined by the first mold.

The production casting system to which the present invention relates also provides a ladle or equivalent device for holding and pouring molten metal into at least one of the downsprue and cavities. In some situations, the production casting line may provide for simultaneous operation of two or more ladles or pouring devices into two or more downsprue and cavities.

In any event, the invention comprises a spalsh guard for selectively creating a molten metal barrier between those first and second downsprue which are defined at least in part by the first mold. Generally, the splash guard is a substantially solid object which may be in the shape of a board, a sheet, or other integral form. The splash guard could conceivably be made of a mesh, if the spacing of mesh were small. The splash guard is made of a material, e.g., such as graphite, that will maintain its structural integrity at high temperature and when contacted by molten metal, but which preferably is not adherent to molten metal that may splatter and cool on its surface.

By "molten metal barrier" is meant a physical structure that prevents the passage or movement of molten metal past the splash guard. In one preferred form, the molten metal barrier is accomplished by positioning the splash guard to abut, i.e., to contact, the mold along the surface that extends substantially continuously between the downsprue. In other preferred forms, particularly those having automated pouring system, such contact of the splash guard with the mold may interfere with the weighting scales on the pouring ladle; in such an embodiment, the molten metal barrier is accomplished by positioning the splash guard a small yet finite distance, e.g., about one-eighth inch, above the mold surface. The spacing distance is chosen to be small enough so that the surface tension of the molten metal prevents the metal from passing between the splash guard and the mold surface. The splash guard thus forms a barrier to the movement of molten metal notwithstanding its spacing above the mold surface.

Production casting lines, as contemplated by this invention, typically provide a moving sequence of molds and a substantially stationary ladle pouring device. The molds are moved, or "indexed", one-by-one into a specific location and position so that the pouring device can deliver the molten metal into a specific cavity. The splash guard of this invention will preferably be selectively movable in such situations. That is, the invention preferably further comprises a positioning device for raising the splash guard (so as to remove the molten metal barrier) once the ladle has stopped pouring and before the molds are indexed to the next position. The positioning device lowers the splash guard (so as to recreate the molten metal barrier) once the molds have been indexed to the next position and before the ladle begins pouring. Raising the splash guard minimizes the risk that the splash guard may drag or knock sand or other foreign material into the cavity when the molds are indexed. The positioning device may comprise a suspension yoke and a hydraulic or gas cylinder, or similar devices known to those of skill in the art.

In particularly preferred form the invention further comprises a controller to coordinate the automatic activation of the positioning device in relation to the automatic indexing of the molds and pouring of the molten metal. The controller may comprise an electrical, mechanical or electro-mechanical switch which is activated by the ladle and the indexing system. Those of skill in the art may recognize further advantages to be gained from micro-processor control systems.

BRIEF DESCRIPTION OF THE DRAWINGS

In the detailed description which follows, reference will be made to the drawing comprised of the following figures.

DETAILED DESCRIPTION OF THE PREFERRED EMBODIMENT

Figure 1:
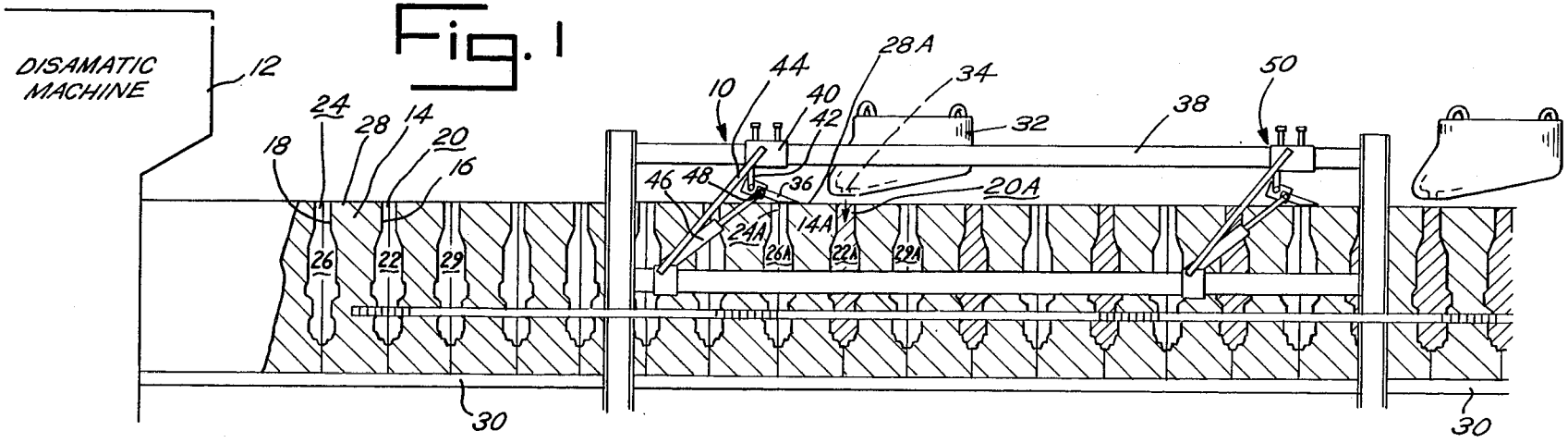
FIG. 1 shows a horizontal side view of a production casting line according to the invention, with the molds of the casting line illustrated in cross-section to reveal the downsprue and cavities.

The method and apparatus of this invention comprise an improved method for casting molten metal. Referring to the drawings, like components are designated throughout by like reference and numerals.

Referring specifically to FIG. 1, the invention comprises a splash guard, generally 10, to be used in combination with prior well known production casting systems. In particularly preferred form, the well known prior production casting systems, according to this invention, comprise a "Disamatic" or similar machine 12 which manufactures a repeating sequence of molds, such as representative mold 14. Representative mold 14 comprises a door half 16 and a ram half 18. The designations "door" and "ram" are believed to be well known in the art, derive from the manufacturing technique used by the "Disamatic" machine, and are not otherwise essential to the explanation of this invention. Suffice to say that the door half 16 of mold 14 comprises the front surface and the ram half 18 comprises the rear surface of representative mold 14.

In the production casting system, the door half of one mold abuts the ram half of another mold. The indentations which have been embossed into the door half and the ram half of the respective molds cooperatively define a downsprue 20 which leads to a cavity 22. The mold 14 will have at least one additional surface, preferably a top surface 28, that extends in a substantially continuous manner between the portions of the first and second downsprue, 20 and 24 respectively, which are defined by the mold 14. The "Disamatic" machine 12 places the molds on a pouring rail 30 which, in turn, moves or "indexes" the molds into position where molten metal may be sequentially poured into the respective cavities.

Continuing in reference to FIG. 1, a ladle 32 is located in the proximity of the pouring position. The ladle 32 holds a batch of molten metal whose physical condition will vary, depending upon the operation, in a manner known to one of ordinary skill in the art. The ladle 32 includes a pouring spout 34 which is positioned directly over the first cavity 22A when the mold form 14A has been indexed so that the cavity 22A is in pouring position. Molten metal is then poured from the ladle 32 through the pouring spout 34 and into the first cavity 22A.

Figure 2:
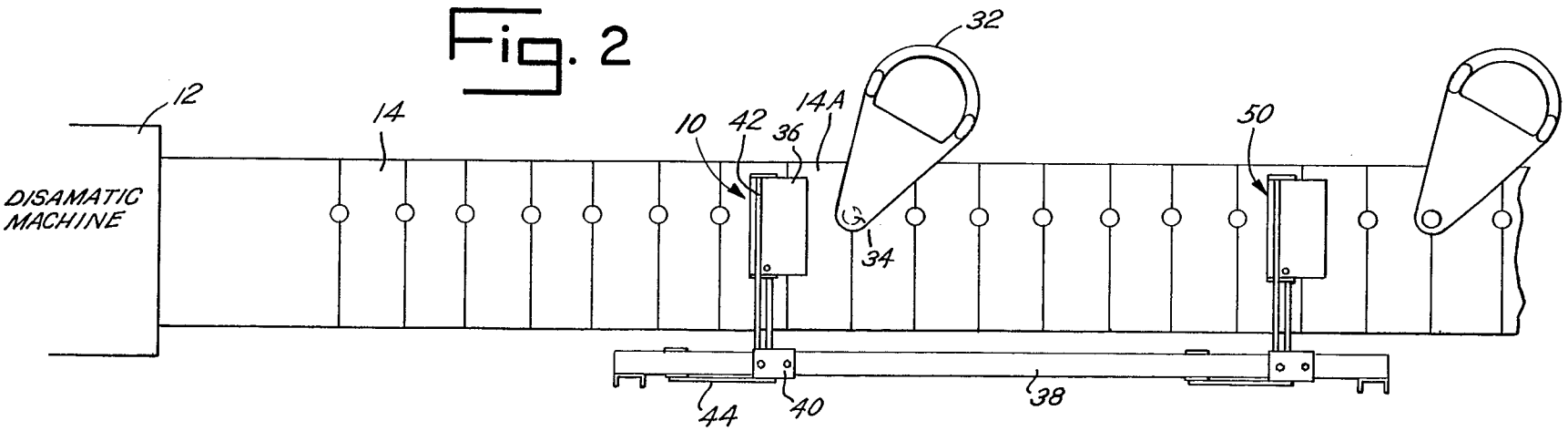
FIG. 2 shows a top view of the production casting line previously shown in FIG. 1.

In actual operation, molten metal which is intended to be poured into cavity 22A may splatter or overflow into an adjacent cavity, such as cavity 26A. The present invention provides a splash guard, generally 10, to prevent such inadvertent introduction of molten metal into the cavity 26A. As shown in FIGS. 1 and 2, the splash guard comprises a graphite shield 36 which is suspended from a guard rail 38 by means of a clamp 40, yoke 42, and support arm 44. The graphite shield 36 may be raised or lowered by means of a hydraulic cylinder 46 which is connected to the shield 36 at pivot point 48.

Graphite is preferably selected as the material from which to construct the shield 36 because of graphite's high ability to retain its structural integrity and shape even in the presence of high temperatures and even when contacted by molten metal. In addition, graphite has the property that molten metal which splashes upon it and subsequently cools and solidifies will not rigidly adhere to the graphite. Thus the shield can be cleaned from time to time and avoid metal build-up and related damage. The shield 36 could adequately be made from other materials having these same properties or possibly less than all of these properties. However, such a shield may not have all of the advantages of the graphite shield disclosed in this invention.

In heavy duty operation, it has been found that the graphite shield may not have sufficient structural strength to withstand the related wear and tear. In this event, it is possible to mount the graphite shield over a metal substrate with the graphite surface exposed to the molten metal. This embodiment will retain the advantages of the graphite shield surface with the additional strength of the metal substrate.

The guardrail 38 and clamp 40 may be of any suitable design well recognized by a person of ordinary skill in the art. However, in particularly preferred form, the rail 38 will have a non-circular, i.e., preferably rectangular or hexagonal, exterior configuration. The clamp 40 should have an internal configuration which matches the exterior configuration of rail 38. The non-circular surfaces of rail 38 and clamp 40 minimize slippage and undesired movement of the graphite shield 36.

The cylinder 46 has been described as a hydraulic cylinder. However, an airpowered cylinder or mechanical powerscrew could work well within the scope of this invention. The cylinder 46 provides a power actuated means to raise or lower the shield 36 as desired. That is, when molten metal is poured through the spout 34 of ladle 32 into the cavity 22A, the shield 36 contacts the top surface 28A of mold 14A and intersects that surface 28A between the two downsprue 20A and 24A. The contact between shield 36 and top surface 28A thereby defines the molten metal barrier to prevent the inadvertent movement, splattering or other translocation of molten metal into the cavity 26A.

Once the cavity 22A has been filled with molten metal, however, pouring from ladle 32 will stop and the sequence of molds on the pouring rail 30 will be advanced or "indexed" so that the next cavity 26A is brought into position to receive molten metal. If the graphite shield 36 were to be left in contact with the top surface 28A of mold 14A during this movement or indexing, the graphite shield 36 could drag sand or other foreign material into the cavity 26A, a situation which could also have serious quality control complications. In order to avoid this problem, the cylinder 46 is actuated to raise the shield 36 out of position, up and away from the top surface 28A of mold 14A. Once the sequence of molds on the pouring rail 30 have been indexed and the next cavity 26A is brought into pouring position, the cylinder 46 is activated so as to drop or lower the graphite shield 36 back into contact with the mold surface and thus re-establish the molten metal barrier in relation to the next empty cavity.

The casting operation shown in FIGS. 1 and 2, includes two separate and distinct pouring positions. The invention contemplates that the second designated generally as item 50 in FIG. 1. The second splash guard 50 would include all of the same elements previously described in relation to splash guard 10.

Note however, that the presence of two separate and distinct pouring locations permits variation in the sequence of filling the cavities. In FIG. 1 for example, the first ladle 32 fills every other cavity in the sequence of molds produced by the Disamatic machine, thereby leaving open every alternate cavity to be filled by the second ladle in pouring position. In this situation, it may be desirable to include two splash guards at the first pouring location. One of the splash guards at the first pouring location would create a molten metal barrier between cavities 22A and 26A as shown in FIG. 1. The second splash guard at the first pouring location (not shown) might create a molten metal barrier between the cavity 22A and 28A. Although this second splash guard is not illustrated in FIG. 1, it would include the same component elements and operate in the same way as that shown for the splash guard 10.

Alternatively, the first ladle 32 might pour each cavity continuously until it runs out of metal, at which time pouring would be temporaily interrupted while the first ladle was refiled. In this situation, pouring at the second ladle would assume to fill each passing cavity while the first ladle was refiled. In this situation, the second splash guard 50 operates at the second ladle in the same way that the first splash guard 10 operates at the first ladle.

Figure 3:
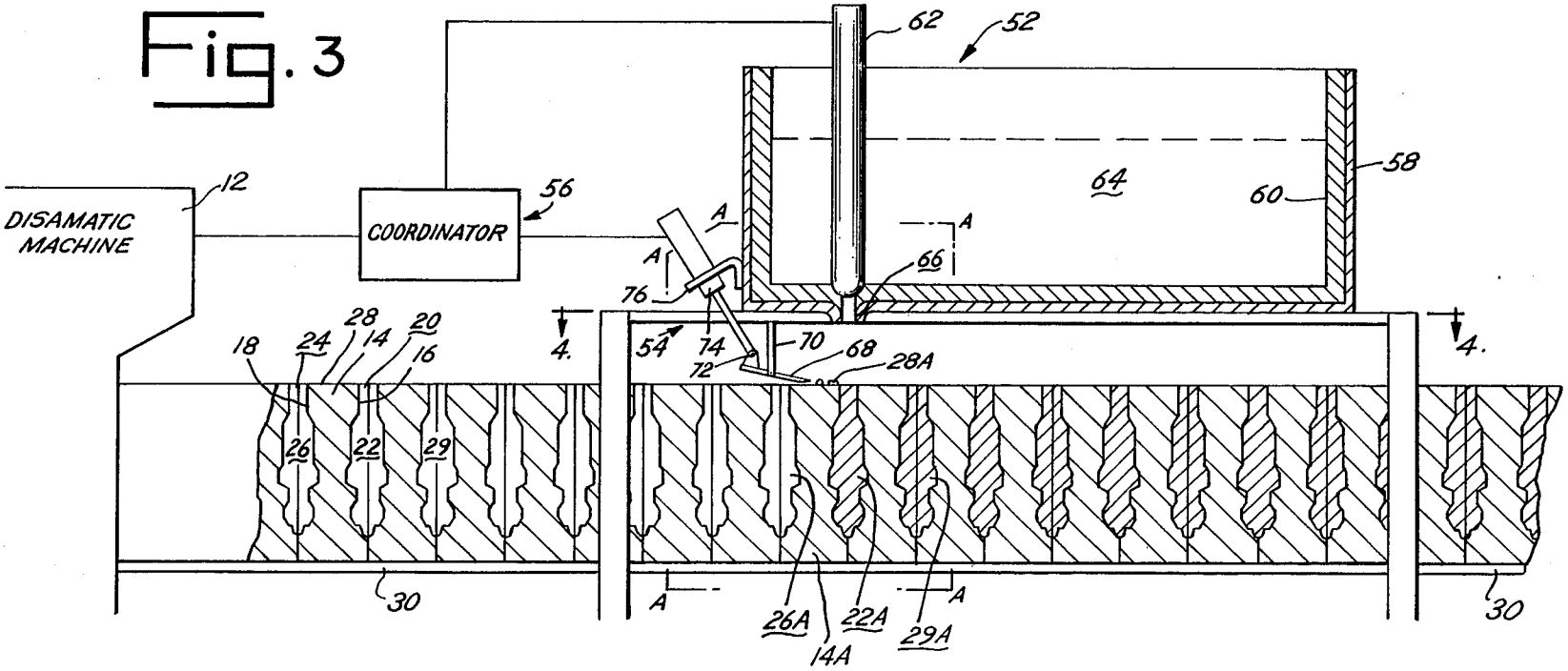
FIG. 3 shows a horizontal side view of the present invention similar to FIG. 1, but embodied in a production casting line having an automated pouring system.
Figure 4:
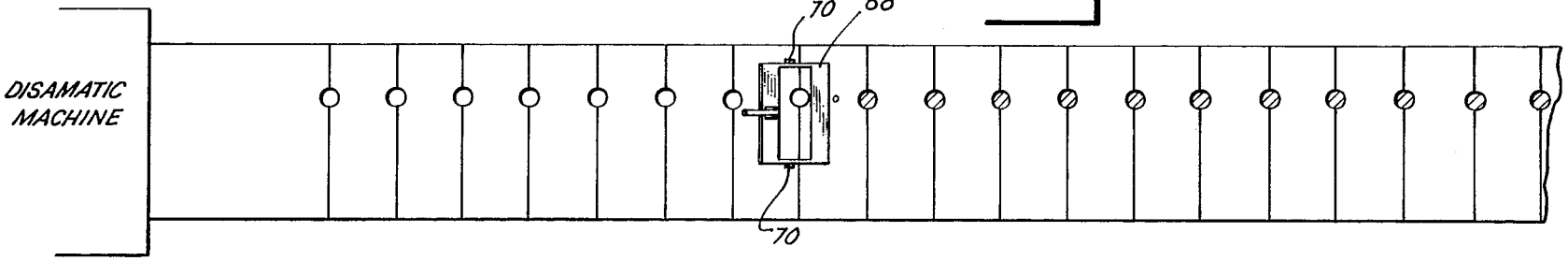
FIG. 4 shows a top view of the production casting line with automated pouring system taken along line 4—4 of FIG. 3.

Turning now to FIGS. 3 and 4, it would be readily apparent to a person of ordinary skill in the art that these figures involve a production casting system which utilizes the same system for mold manufacture and mold movement as previously described in relation to FIGS. 1 and 2. More specifically, the "Disamatic" machine 12, reference mold 14, door half 16, ram half 18, downsprue 20 and 24, cavities 22, 26 and 28, top surface 28, and pouring rail 30 of FIGS. 3 and 4 are substantially the same as those of FIGS. 1 and 2. Similarly, the molds, cavities and surfaces shown at the pouring location in FIG. 3 may be represented by those same elements as described in FIGS. 1 and 2, and similar numerals have been used accordingly. The principal difference between the embodiment of FIG. 3 as opposed to that of FIG. 1 lies is in the technique used for pouring the molten metal and the manner in which the splash guard of this invention is modified to most advantageously cooperate with the different pouring technique.

More specifically, instead of the ladle 32 shown in FIG. 1, molten metal is poured by the automatic pouring device designated generally 52 in FIG. 3. The splash guard of this invention, designated generally as 54 in FIG. 3, is mounted directly on to the automated pouring device 52. The splash guard 54 is coordinated in relation to both the pouring action of automatic pouring device 52 and the indexing of molds by the "Disamatic" machine 12 by means of a coordinator designated generally 56.

The automatic pouring device 52 comprises a holding shell 58, a refractory liner 60, and a stopper rod 62. The holding shell 58 provides sufficient structural strength and integrity to hold large amounts of molten metal. The refractory liner 60 isolates and protects the shell 58 from the molten metal. The shell 58 and refractory liner 60 cooperatively define a pouring vessel 64 having a pouring nozzle 66. In a non-pouring condition, a stopper rod 62 is moved downward in the pouring vessel 64 such that the rod 62 mates with and blocks the nozzle 66. The stopper rod 62 thus prevents any metal from flowing out of the nozzle 66. When it is desired to pour molten metal from the vessel 64, the stopper rod 62 is retracted or moved away from the nozzle 66 such that the molten metal can flow therethrough.

In the automatic pouring embodiment, such as FIG. 3, the amount of metal to be poured from the vessel 64 is determined by an automatic weighing scale (not shown). The difference in the splash guard 54 of FIG. 3 as opposed to the splash guard 10 shown in FIG. 1 relates particularly to the aspect of the automatic pouring technique involving the scale.

The weighing scale essentially comprises the entire pouring vessel 64. The amount of metal which is poured out of the pouring vessel and into the cavity is predetermined to be a certain amount, i.e., weight, of metal. The automated machinery measures the amount of metal delivered via weight. That is, the stopper rod 62 is lifted until the scale has determined that the appropriate weight of metal has been poured, at which time the stopper rod 62 is retracted downward and the pouring action is stopped.

As previously noted, the splash guard 54 of this invention is mounted on the holding shell 58. If the splash guard 54 were permitted to contact the top surface 28A of the mold 14A, the splash guard would inherently exert an upward force on the pouring vessel thereby interfering with the action of the weighing scale. Surprisingly however, this invention teaches a technique to implement the advantages of the splash guard 54 and create the molten metal barrier without even contacting the top surface 28A of the mold 14A.

Figure 6:
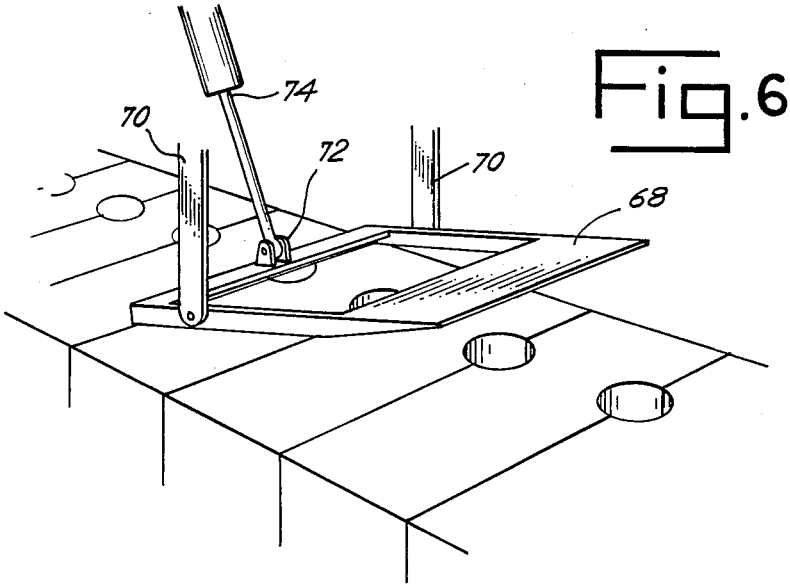
FIG. 6 shows an enlarged close-up of the splash guard from FIG. 5, but oriented in its "up" position.

More specifically, the splash guard 54 comprises a graphite shield 68, a support arm 70, a pivot point 72, a hydraulic cylinder 74, and a mounting bracket 76. The graphite shield 68 comprises the same type of graphite shield 36 previously described in connection with FIG. 1. The shield 68 of FIG. 3 is attached indirectly to the automatic pouring device 52 by support arm 70. The hydraulic cylinder 74 is attached to the holding shell 58 by mounting bracket 76. The cylinder 74 is connected to the graphite shield 68 at pivot point 72. When the cylinder 74 is fully extended the shield 68 is moved into an upward position, as shown in FIG. 6. Conversely, when the hydraulic cylinder 74 is retracted, the graphite shield 68 is lowered into a downward or guard position as shown in FIG. 3.

Even in the downward or guard position, as shown in FIG. 3, however, the splash guard 54 does not contact the top surface 28A of mold 14A. The mounting and design of the cylinder 74 and the splash guard 54 are such that, even when the cylinder 74 is in the retracted position and the shield 68 is lowered into the operating condition, the shield 68 is spaced a small yet finite distance above the top surface 28A of mold 14A. This situation is shown more clearly in FIG. 5.

Figure 5:
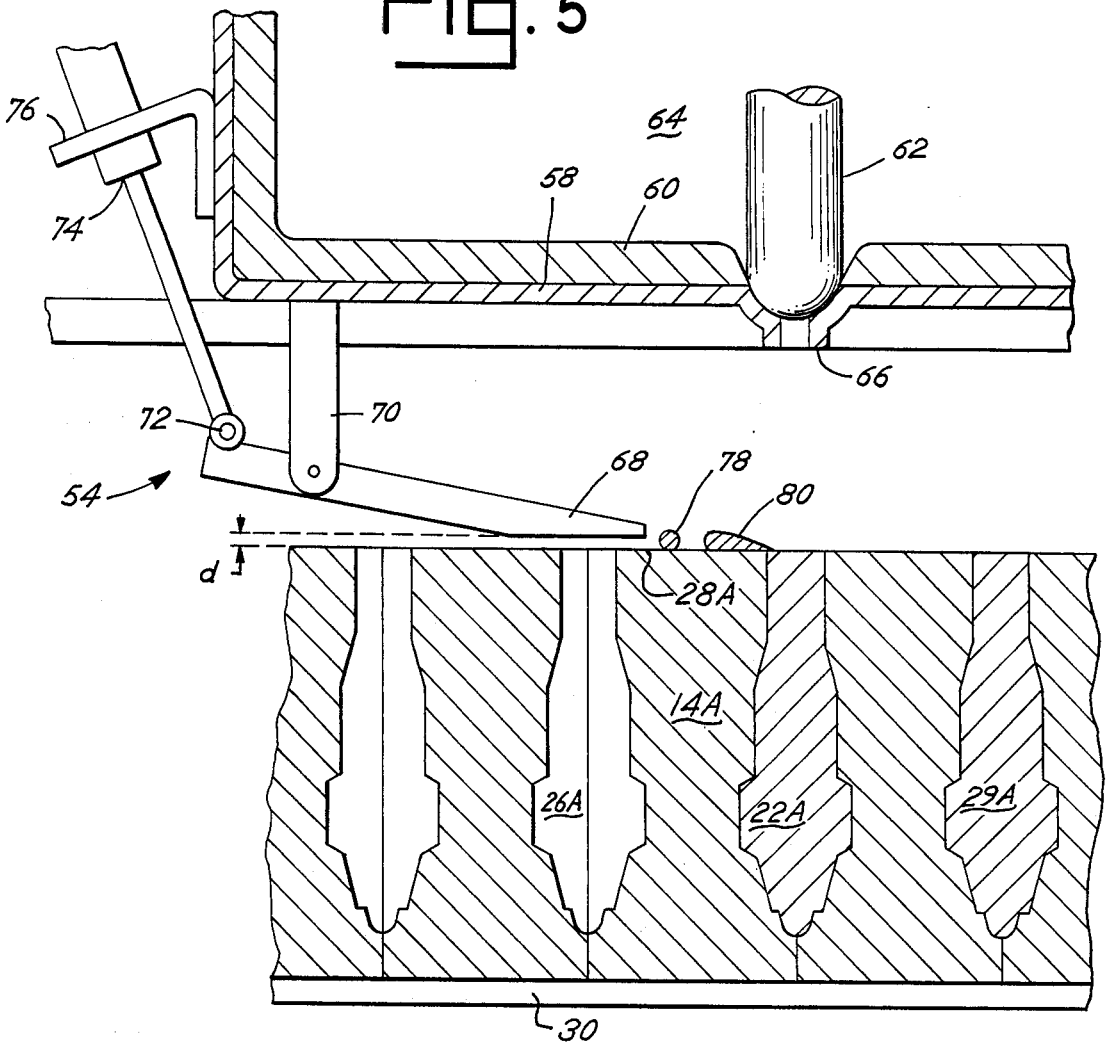
FIG. 5 shows an enlarged, close-up view of the splash guard, pouring device, and molds previously illustrated in area "A" of FIG. 3. Note that the splash guard is oriented in its "down" position.

For purposes of illustration, a small droplet 78 and small puddle 80 of molten metal are shown in FIG. 5. The small droplet 78 may have occurred from splashing, and the small puddle 80 may have occurred from overflow of the molten metal in cavity 22A. In either event however, the surface tension of the molten metal causes the droplet 78 or the puddle 80 to maintain a finite minimum height above the surface 28A of mold 14A. The design of the splash guard 54 in FIG. 5 is carefully prepared so that the lowest point of the graphite shield 68 is maintained at least a distance "d" above the surface 28A. This distance "d" is less than the minimum height of the droplet 78 or puddle 80 of the molten metal caused by the surface tension of the molten metal on the surface 28A. The minimum height of the droplet 78 or puddle 80 may be readily determined empirically and will vary with the type of metal, surface material, and the temperature and other physical conditions of the metal and surface material as would be readily apparent to one of ordinary skill in the art. By using the technique shown in FIGS. 3, 4, and 5 however, it is apparent that the splash guard 54 will not affect the weighing scale and the automatic pouring action of the pouring device 52.

In particularly preferred form, and in order to make most advantageous use of the automated system, the up and down movement of the splash guard 54 can be automatically coordinated in relation to the pouring action of the device 52 and the indexing of the molds 14. Such coordination can be accomplished by coordinator 56 in FIG. 3. Although the internal circuit diagrams and mechanical configuration of coordinator 56 are not shown, it is believed that they would be readily apparent to a person of ordinary skill in the art. Generally, the automatic pouring system 52 will conventionally have some device or control system for raising and lowering the stopper rod 62 so as to pour the molten metal in relation to when the molds are properly indexed on the pouring rail 30. That conventional control system will monitor when the "Disamatic" machine has completed the preparation of an additional mold so as to index the molds on the pouring rail at an appropriate time; it will also monitor the weighing scale so as to raise and lower the stopper rod in relation to when the proper amount of metal has been poured. At some point in the cycle when the proper amount of metal has been poured, the coordinator 56 will lower the stopper rod to cease the pouring action. Once the stopper rod has been lowered and the pouring action has been stopped, the coordinator will advance or index the molds on the pouring rail 30 to the next position. Once the molds have been properly indexed and the next cavity is in the pouring position, the coordinator will again raise the stopper rod 62 to begin pouring the next increment of molten metal. As indicated, all of this action is conventional and the electrical circuitry, switch mechanisms, and other structure necessary to accomplish this goal are also conventional.

For purposes of this invention however, the control system, shown here as coordinator 56 will also coordinate the action of the splash guard 54. That is, the coordinator 56 will actuate the hydraulic cylinder 74 so that the graphite shield 68 is lowered into the molten metal barrier position after the molds have been indexed and an empty cavity is moved in to the pouring position and before the stopper rod has been retracted to begin the pouring of molten metal. Similarly, once the molten metal has been poured and the cavity in the pouring position is filled, and the stopper rod is retracted to cease the pouring position, the coordinator 56 will then actuate cylinder 74 so as to raise the graphite shield 68 away from the top surface 28A of the mold 14A before the pouring rail 30 moves or indexes the molds. In this way, the shield 68 will be separated from the top surface 28A by a substantial distance and thus minimize the possibility that the shield 68 will drag sand or other foreign objects into the next cavity. This situation presents serious quality control risk because metal slag on the shield 68 may scrape along the surface 28A even though shield 68 is itself spaced above the surface 28A.

The above description relates to the preferred embodiments of the invention. However, alternate configurations and modifications to the embodiments shown in the drawing are possible within the scope of the invention. Therefore, the subject matter of this invention is to be limited only by the following claims and their equivalents.

What is claimed is:

1. System for improved production casting of molten metal, comprising in combination:

a mold which defines at least portions of first and second downsprue and first and second cavities, said first and second downsprue leading to said first and second cavities, respectively, said mold having at least one surface which is substantially continuous between said portions of said first and second downsprue;

ladle means for pouring molten metal into at least one of the downsprue;

splash guard means for selectively providing a molten metal barrier between the first and second downsprue at a predetermined time and location.

2. The system of claim 1 wherein the splash guard means comprises a substantially solid object that contacts the mold along said one surface between the first and second downsprue.

3. The system of claim 1 wherein the splash guard means comprises a substantially solid object spaced a predetermined distance above said one surface, said predetermined distance being less than the effective height of molten metal on said one surface due to surface tension.

4. The system of claim 3 wherein the predetermined distance is approximately one-eight inch.

5. The system of claim 1 wherein the splash guard means comprises a material that will maintain its structural integrity at high temperatures and when contacted with molten iron, and which is characterized in that molten metal does not bond to it upon cooling.

6. The system of claim 1 wherein the splash guard comprises a graphite shield.

7. The system of claim 1 further comprising positioning means to move the splash guard means to a first predetermined location at a first predetermined time and to a second predetermined location at a second predetermined time, said first predetermined location and time being characterized by the creation of said molten metal barrier prior to pouring of molten metal into said first downsprue, and said second predetermined location and time being characterized in that said one mold form can be freely moved without contacting said splash guard when molten metal is not being poured, and said system further comprising coordination means to activate said positioning means to said first predetermined location before said ladle means begins to pour molten metal into said first downspurue and to activate said positioning means to said second predetermined location after said ladle means completes pouring molten metal into said first downsprue.

8. An improved method for preventing molten metal which is being poured into a first cavity from being prematurely introduced into an adjacent second cavity, said first and second cavities being defined at least in part by a mold which also defines at least in part first and second downsprue leading to said first and second cavities, respectively, said mold also having a substantially continuous surface extending between said portions of said first and second downsprue, the improved method comprising the step of:

selectively positioning a splash guard between the first and second downsprue during the pouring of said molten metal, said splash guard defining a molten metal barrier.

9. The improved method of claim 8 wherein the positioning step comprises lowering the splash guard to a first predetermined position prior to the start of the pouring of molten metal into said first cavity, said first predetermined position being characterized in that the splash guard contacts the mold along said surface between the portions of the first and second downsprue.

10. The improved method of claim 8 wherein the positioning step comprises lowering the splash guard to predetermined position prior to the start of the pouring of molten metal into the first cavity, said first predetermined position being characterized in that the splash guard is spaced apart from said surface a predetermined distance which is less than the effective height of molten metal droplets on said surface due to surface tension.

11. The method of claim 8, wherein said predetermined distance is about one-eighth inch.

12. An improved method for preventing molten metal which is being poured into a first cavity from being prematurely introduced into an adjacent second cavity, said first and second cavities being defined at least in part by a mold which also defines at least in part first and second downsprue leading to said first and second cavities, respectively, said mold also having a substantially continuous surface extending between said portions of said first and second downsprue, the improved method comprising the steps of:

selectively positioning a splash guard between the first and second downsprue during the pouring of said molten metal, said splash guard defining a molten metal barrier, and raising the splash guard away from the surface after the pouring of molten metal into said first cavity is complete.

13. The improved method of claim 12 further comprising the step of indexing the molds by moving them to a new operating position in which molten metal can be poured into said second cavity.

* * * * *